US005440088A

United States Patent [19]

Coudert et al.

[11] Patent Number: 5,440,088

[45] Date of Patent: Aug. 8, 1995

[54] MOLDED CASE CIRCUIT BREAKER WITH AUXILIARY CONTACTS

[75] Inventors: Patrick Coudert, Eybens; Jean-Pierre Nereau, Seyssinet; Philippe Perrier, Lumbin, all of France

[73] Assignee: Merlin Gerin, France

[21] Appl. No.: 120,418

[22] Filed: Sep. 14, 1993

[30] Foreign Application Priority Data

Sep. 29, 1992 [FR] France ..... 92 11730

[51] Int. Cl.[6] ..... H01H 3/04

[52] U.S. Cl. ..... 200/303

[58] Field of Search ..... 200/312, 303

[56] References Cited

U.S. PATENT DOCUMENTS 4,622,444 11/1986 Kandatsu et al. ..... 200/303
4,831,221 5/1987 Yu et al. ..... 200/303 X
4,926,148 5/1990 Cambreleng ..... 200/303 X
5,140,115 8/1992 Morris ..... 200/312 X

FOREIGN PATENT DOCUMENTS 7927344 4/1929 Germany .
2814070 4/1979 Germany .
2221347 1/1990 United Kingdom .

*Primary Examiner*—Renee S. Luebke
*Attorney, Agent, or Firm*—Parkhurst, Wendel & Rossi

[57] ABSTRACT

A molded case circuit breaker includes standard compartments each designed to accommodate a standard auxiliary indication or control unit. Each compartment is assigned to a predetermined function, the control device associated with this compartment being connected to the corresponding components of the circuit breaker supplying the information relating to this function. Customization of the circuit breaker can be performed by the distributor or fitter who fits a standard auxiliary unit in the compartment or compartments.

10 Claims, 7 Drawing Sheets

FIG. 5
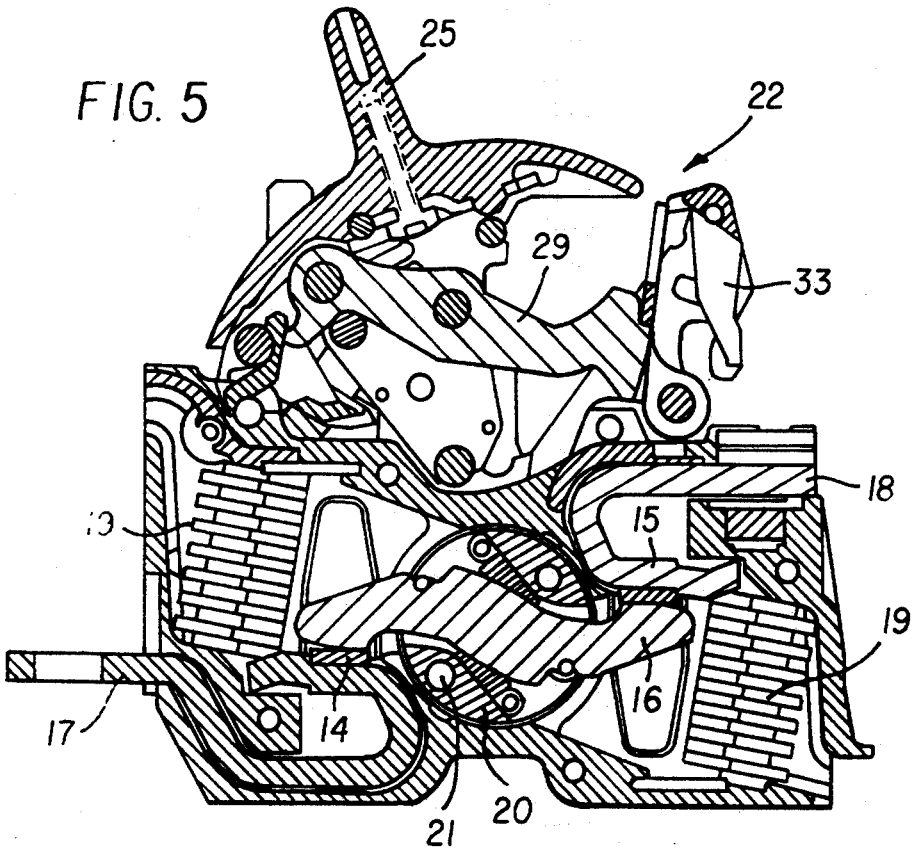
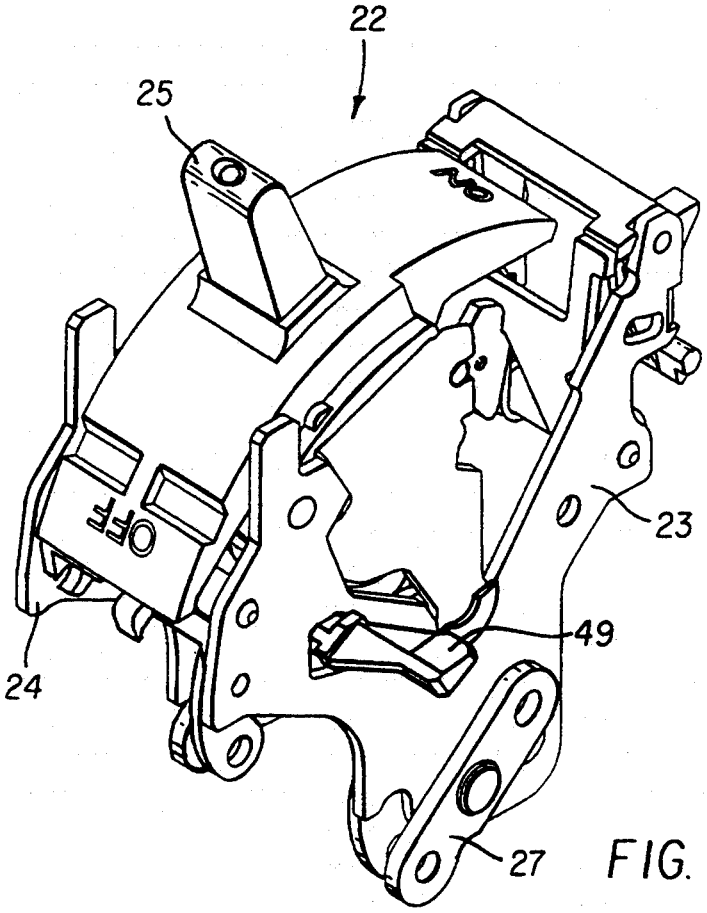
FIG. 6

MOLDED CASE CIRCUIT BREAKER WITH AUXILIARY CONTACTS

BACKGROUND OF THE INVENTION

The invention relates to a low-voltage electrical circuit breaker comprising:

- a plurality of juxtaposed poles, each pole having at least one stationary contact and one moveable contact, and a bar section bearing the movable contact,
- a molded case in which the poles are housed, the case having a base, a cover in two parts, and compartments arranged in the cover,
- a spring mechanism actuating the bar sections having two stable positions, a set position and a discharged position,
- a manual operating handle of the mechanism protruding out from the cover,
- a trip device bringing about automatic opening of said contacts when a fault occurs,
- auxiliary units performing indication and/or control functions, each of said compartments being able to accommodate an auxiliary unit.

A state-of-the-art circuit breaker of the kind mentioned is customized when it is installed by the addition of auxiliary units suitable for the application or for the corresponding electrical installation. These auxiliary units are for example contacts for indicating the open or closed position of the contacts, or for indicating tripping on a fault, or for any other control or indication. These auxiliary units cooperate electrically or mechanically with components of the circuit breaker, and are housed in compartments accessible after a protective plate or cover has been removed. The compartments are advantageously electrically insulated from the other parts of the circuit breaker to enable the auxiliary units to be fitted or removed, with the switchgear device being live. Each auxiliary unit is designed for its function, and its structure and dimensions vary according to the type of function performed. The compartments are in turn designed for the type of corresponding auxiliary units, and can even comprise error preventors preventing an unsuitable auxiliary unit from being fitted.

Customization of the circuit breaker by the distributor or fitter has the advantage of reducing stocks, but this reduction is limited by the fact that four or five different types of auxiliary units can be added to each circuit breaker. The fitter or distributor therefore has to have these four or five types of auxiliary units available, and this set of auxiliary units is frequently supplied with the circuit breaker, the unused units simply being thrown away.

The object of the present invention is to improve these circuit breakers and to reduce the number of types of auxiliary units.

SUMMARY OF THE INVENTION

The circuit breaker according to the invention is characterized in that the compartments and the auxiliary units are standard components, that each compartment comprises a control device of the associated auxiliary unit, said control devices being standard, and that each compartment is customized and assigned to a given function, this function being performed by the standard auxiliary unit housed in the compartment corresponding to this function.

The auxiliary units are standard and the fitter will be able to customize the circuit breaker and meet the different requirements from a single stock. The standard auxiliary unit comprises at least one auxiliary contact actuated by a pushbutton, which cooperates after it has been fitted in the corresponding compartment with the control device of this compartment. The control devices of the different compartments are naturally located at the same locations and perform the same actuating travel, the difference consisting in the electrical or mechanical connection with the components of the circuit breaker.

The invention is advantageously applied to a circuit breaker of the kind described in U.S. Pat. No. 5,281,776, in which circuit breaker each pole comprises a housing made of molded plastic material in which a bar section is housed bearing a movable contact bridge. The different poles of the circuit breaker are juxtaposed in a case whose cover comprises the compartments housing the auxiliary unit. One of these compartments, in this instance for indicating the position of the circuit breaker contacts, comprises a control device mechanically connected to the bar bearing the movable contact bridge, so as to represent the position of the contacts and to actuate the auxiliary contact of the unit housed in this compartment in consequence. The mechanical connection between the contact-bearing bar and the contact position indication control device is preferably formed by a slide, inserted between two polar housings, said slide transmitting the movements of the bar by translation to said control devices of the compartment.

Another compartment is assigned to indication of tripping and this compartment comprises for this purpose a control device which cooperates with the setting and disarming hook of the mechanism. The standard auxiliary unit, housed in this compartment, will thus translate the position of the mechanism hook and will indicate tripping. The circuit breaker can also comprise a compartment for indicating tripping on an electrical fault, said compartment then being arranged facing a housing of a control relay acting on the circuit breaker trip bar. The control device of this compartment is then connected to this control relay to indicate a tripping order on an electrical fault.

Customizing the circuit breaker is particularly simple since the distributor or fitter simply fits a standard auxiliary unit in the compartment assigned to the required function. The function performed by the compartment can be noted by any suitable means, for example by an inscription. The unused auxiliary units can naturally be used for other circuit breakers, and any wastage or useless stock is thus avoided.

The compartments are preferably located on each side of the operating mechanism and after the auxiliary units have been fitted, they are blanked off by a second part of the cover, which may be a plate forming the front panel of the circuit breaker. The auxiliary units are preferably fixed in the compartment by simple clipping, enabling an auxiliary unit to be removed and replaced on request.

BRIEF DESCRIPTION OF THE DRAWINGS

Other advantages and features will become more clearly apparent from the following description of an illustrative embodiment of the invention, given as a non-restrictive example only and represented in the accompanying drawings, in which:

FIG. 5 is an axial cross-section of a circuit breaker pole and of the associated operating mechanism.

FIG. 6 is a perspective view of the mechanism according to FIG. 5.

Figure 1:
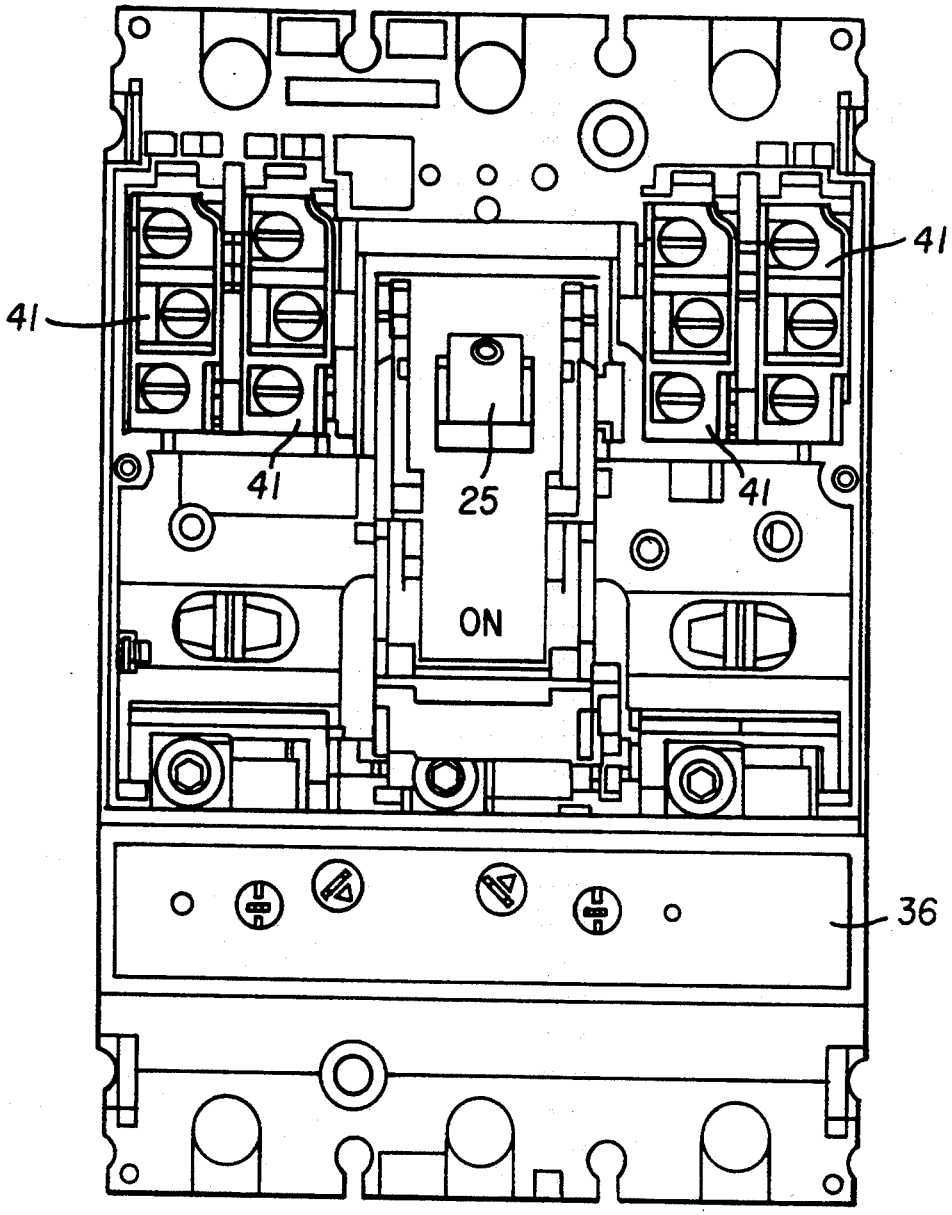
FIG. 1 is a schematic plan view of the circuit breaker according to the invention, the upper part of the cover being assumed to have been removed and auxiliary units being housed in each of the compartments.

The invention is described hereinafter as being applied to a circuit breaker of the kind described in the above-mentioned patent, but it is clear that it is applicable to any other type of molded case circuit breaker.

DESCRIPTION OF THE PREFERRED EMBODIMENT

In the drawings,a molded case 10 of a three-pole circuit breaker formed by a base 11 and a cover 12 contains three single-pole housings 13 arranged side by side. Each housing 13 contains two stationary contacts 14, 15 which cooperate with a rotary contact bridge 16. The stationary contacts 14, 15 are each connected to a connecting strip 17, 18 and each pair of contacts 14, 16; 15, 16 has its associated arc extinguishing chamber 19. The contact bridge 16 is mounted floating in a bar section 20 which communicates thereto the opening and closing movements of the contacts 14, 15, 16. The bar sections 20 of the three housings 13 are securedly united by bars 21 coupled to an operating mechanism, designated by the general reference 22. The mechanism 22 is located above the middle pole of the circuit breaker and is securedly united to the box 13 of this middle pole by two lateral flanges 23, 24 which are spaced apart and frame the mechanism 22. Operating handle 25 is articulated to flanges 23, 24, and protrudes out from the cover 12. On the flanges 23, 24 there is also articulated, by a spindle 26, a crank 27 through which the bars 21 pass to bring about rotation of the bar sections 20. A toggle 28 connects the crank 27 to a hook 29, itself articulated by a spindle 30 on the flanges 23, 24. The end 31 of the hook 29, opposite from the spindle 30, bears a locking surface 32 designed to cooperate with a latch 33. The spindle 34 of the toggle 28 is connected by a spring 35 to the handle 25. In the closed position of the circuit breaker, represented in FIGS. 5 and 7, the spring 35 urges the toggle 28 to the extended position, tending to make the bar sections 20 rotate counterclockwise to maintain the contacts 14, 15, 16 in the closed position. Rightwards pivoting of the handle 25 in FIGS. 5 and 7 displaces the line of action of the spring 35 causing the toggle 28 to be broken and the bar sections 20 to rotate clockwise to open the contacts 14, 15, 16. Actuation of the latch 33 also causes opening of the circuit breaker, by releasing the hook 29 which pivots counterclockwise to the discharged position, represented in FIG. 8, driving the crank 27 and bar sections 20 to the open position of the contacts 14, 15, 16. Resetting of the mechanism 22 results from the movement of the handle 25 to the open position and the handle then merely has to be pivoted in the opposite direction to close the circuit breaker. The latch 33 is controlled by a trip unit 36 associated with or incorporated in the molded case 10. A circuit breaker of this kind is described in U.S. Pat. 5,300,907 , and the reader should advantageously refer to this application for further details on the operation and structure of this circuit breaker.

Figure 2:
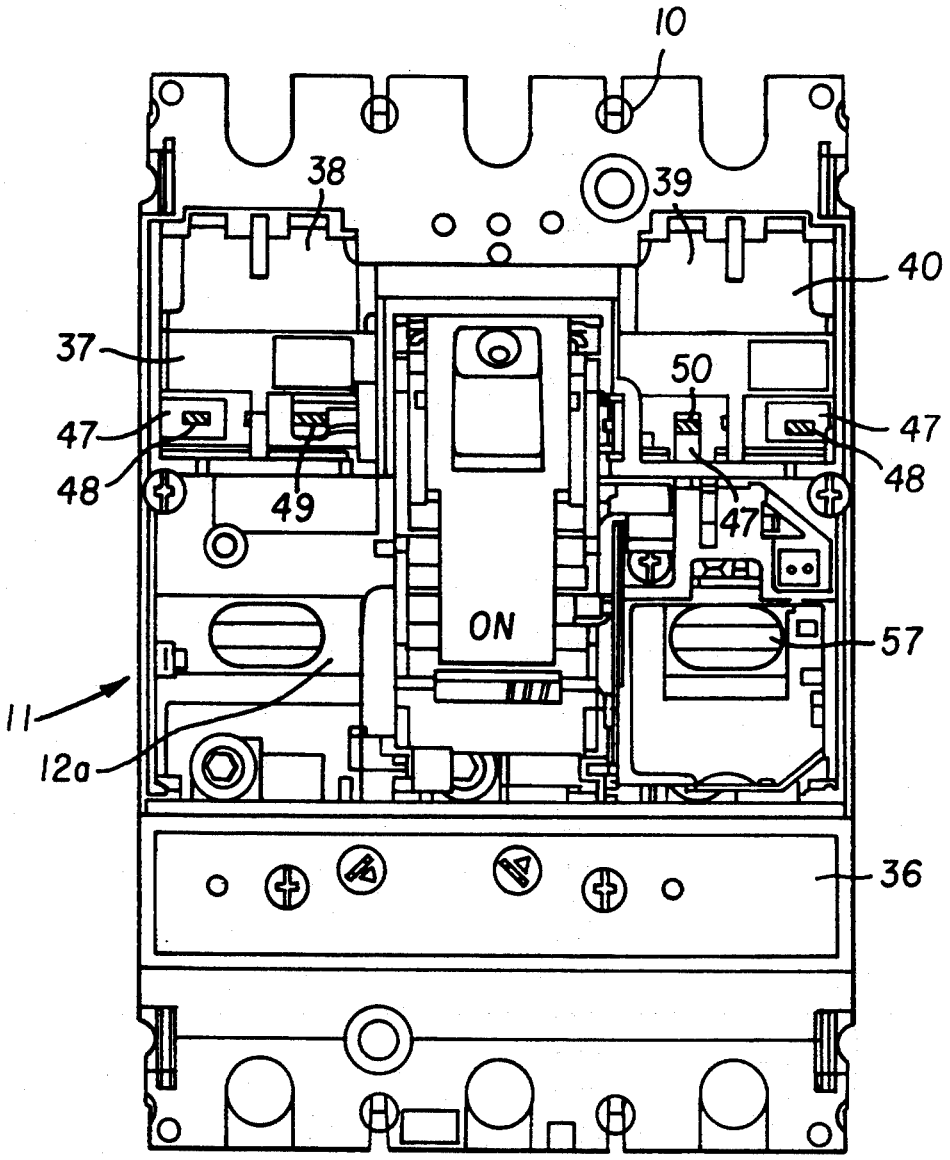
FIG. 2 is a similar view to that of FIG. 1, in which the auxiliary units have been removed.
Figure 3:
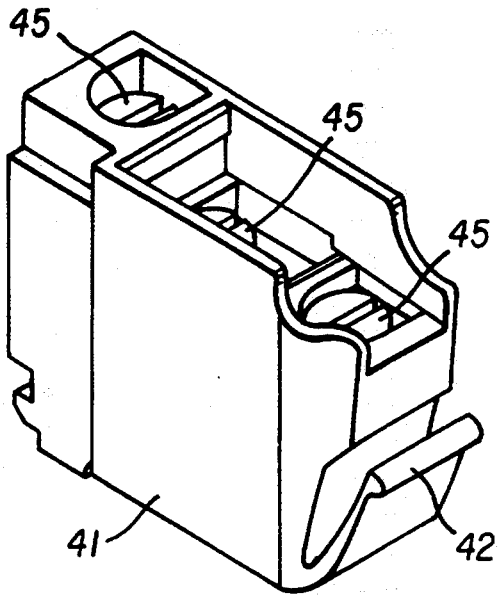
FIG. 3 is a perspective view of an auxiliary unit, according to FIG. 1.
Figure 4:
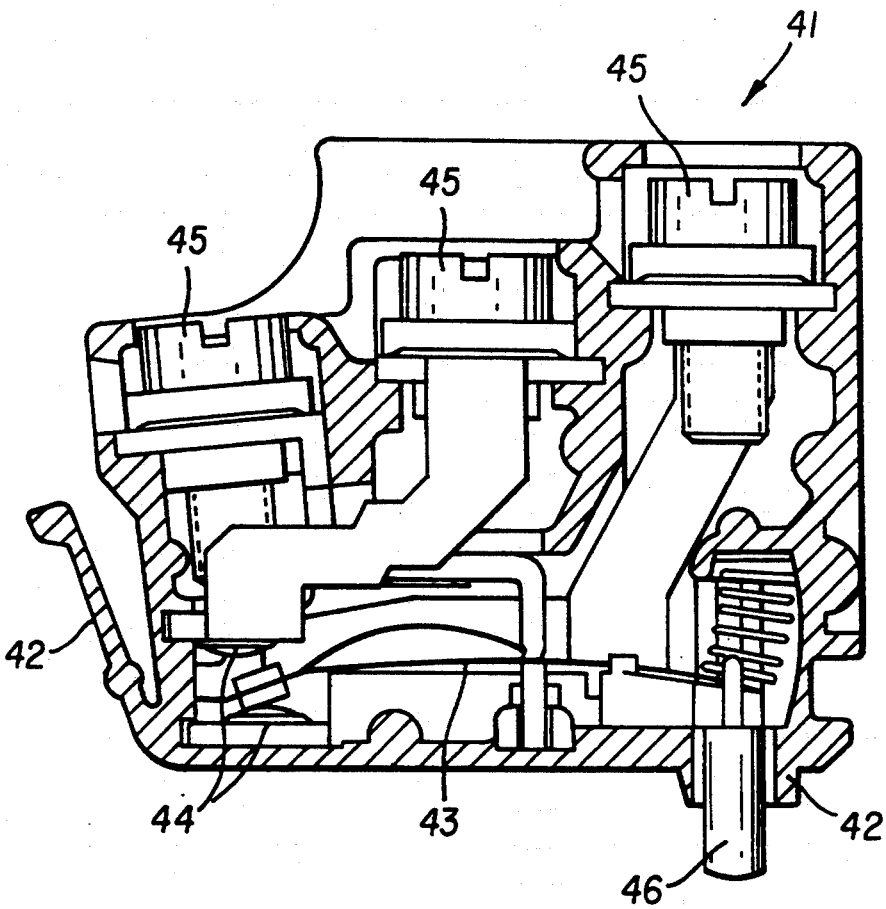
FIG. 4 is a sectional view of the auxiliary unit according to FIG. 3.
Figure 12:
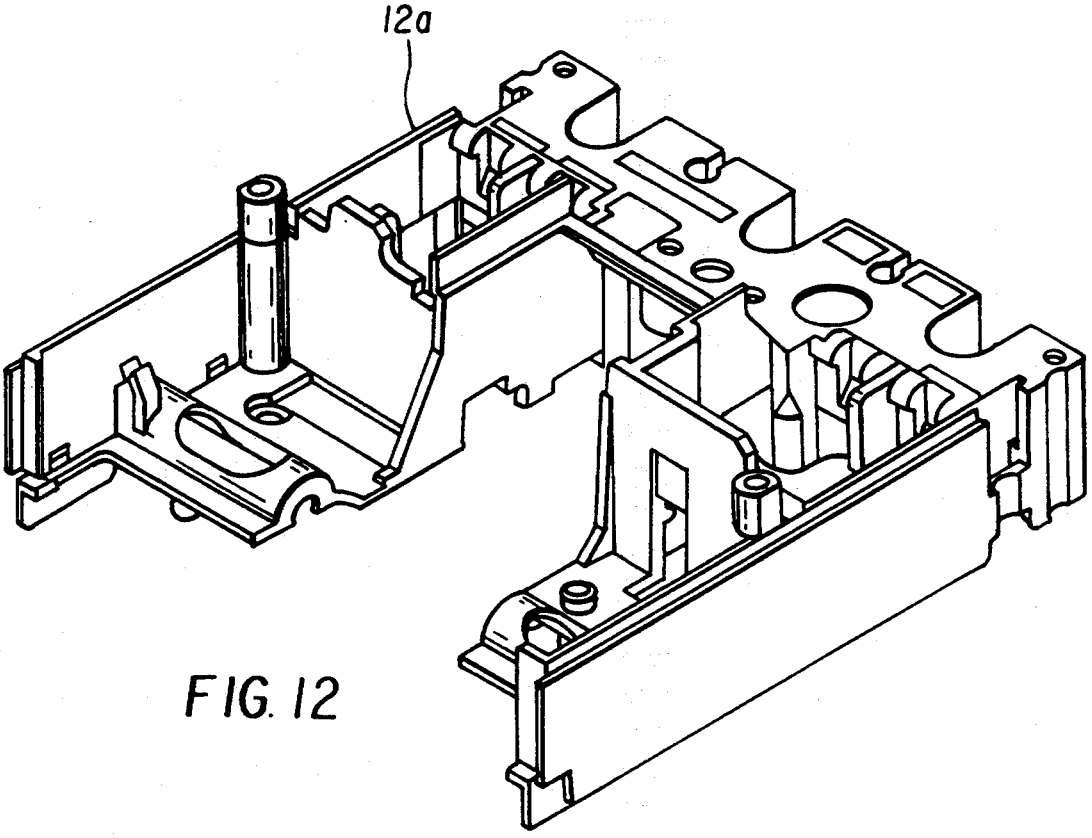
FIGS. 12 and 13 show perspective views of the lower part and the upper part, respectively, of the cover according to the circuit breaker of the present invention.
Figure 13:
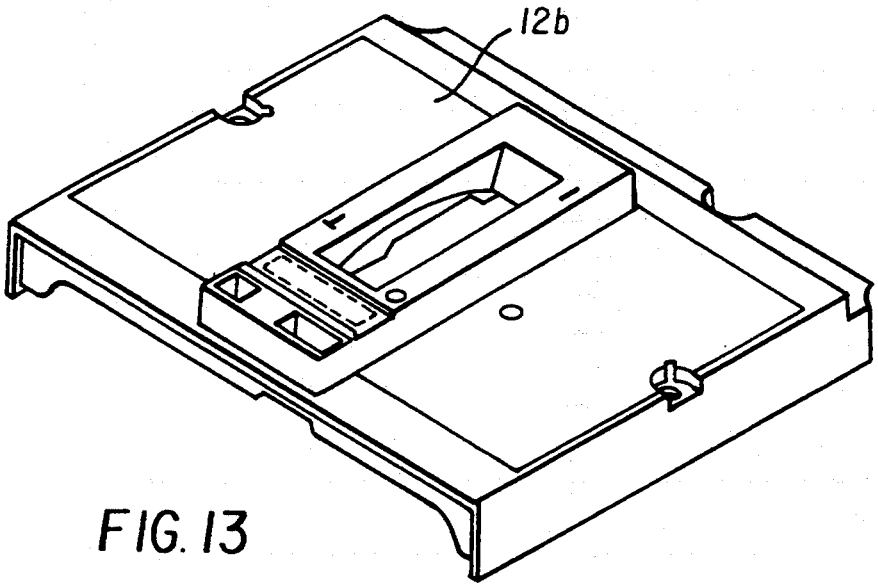

The cover comprises a lower part **12*a* and an upper part 12 *b* (see FIGS. 12 and 13). Removal of upper part 12*b* gives access to four compartments 37, 38, 39, 40 arranged in the lower part 12*a*, as shown in FIG. 2. These four compartments 37–40 are of identical shape and size to each accommodate a standard auxiliary contacts unit 41. Referring more particularly to FIGS. 3 and 4, it can be seen that the auxiliary unit 41 has clipping nose 42, designed to cooperate with conjugate parts of the compartment 37–40, to fix the unit 41, made of insulating material, by clipping in the corresponding compartment. Inside the unit 41 there is pivotally mounted a contact snap blade 43 which cooperates with two stationary contacts 44 to form a changeover contact. The unit 41 bears external connection terminals 45 and a pushbutton 46 for control of the contact blade 43. In the out position of the pushbutton 46, represented in FIG. 4, the contact blade 43 cooperates with the lower stationary contact 44, whereas in the depressed position of the pushbutton 46, the contact blade 43 cooperates with the upper stationary contact 44. It is clear that the auxiliary unit 41 can be arranged in a different manner and comprise a larger or smaller number of contacts 43, 44, as well as a different actuating mode of the pushbutton 46**.

Figure 9:
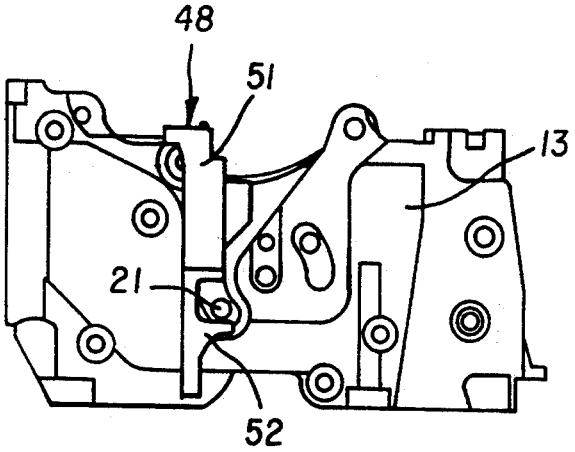
FIGS. 9 and 10 are elevational views of a circuit breaker pole, equipped with a slide for indicating the position of the bar, represented respectively in the closed position and in the open position of the contacts.
Figure 10:
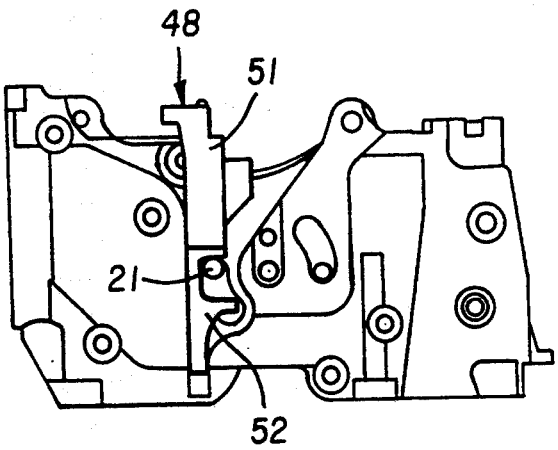

The auxiliary unit 41 is standard and can be fitted in any one of the compartments 37–40, the pushbutton 46 passing through an orifice 47 arranged in the bottom of the compartment 37–40 and giving access to the corresponding control device 48, 49, 50. The actuation travels of all these control devices are identical but these devices cooperate with different component parts of the circuit breaker to customize the corresponding compartment. In the example illustrated by the drawings, the circuit breaker comprises two compartments 37, 40 associated with the circuit breaker contacts open and closed indication function. Another compartment 38 performs indication of tripping of the circuit breaker and the fourth compartment 39 is assigned to indication of tripping on an electrical fault. The control devices 48 of the contact position indication compartments 37, 40 are, in the manner represented in FIGS. 9 and 10, formed by a slide 51 inserted between two single-pole housings 13 and presenting a fork 52 which embraces a connecting bar 21 of the bar sections 20. FIG. 9 represents the position of the bar 21 when the contacts 14, 15, 16 are closed, the slide being in the lowered position, with no action on the pushbutton 46 of the auxiliary unit 41 which remains in the out position. FIG. 10 represents the position of the bar 21 when the contacts 14, 15, 16 are open, the pivoting and upward movement of the bar 21 having moved the slide 51 upwards to depress the pushbutton 46 and actuate the contact blade 43 of the auxiliary unit 41. This control mode by a slide 51 is particularly simple and dependable, but it is obvious that the information relating to the position of the contacts can be taken at another place and can be transmitted to the pushbutton 46 by other means.

Figure 7:
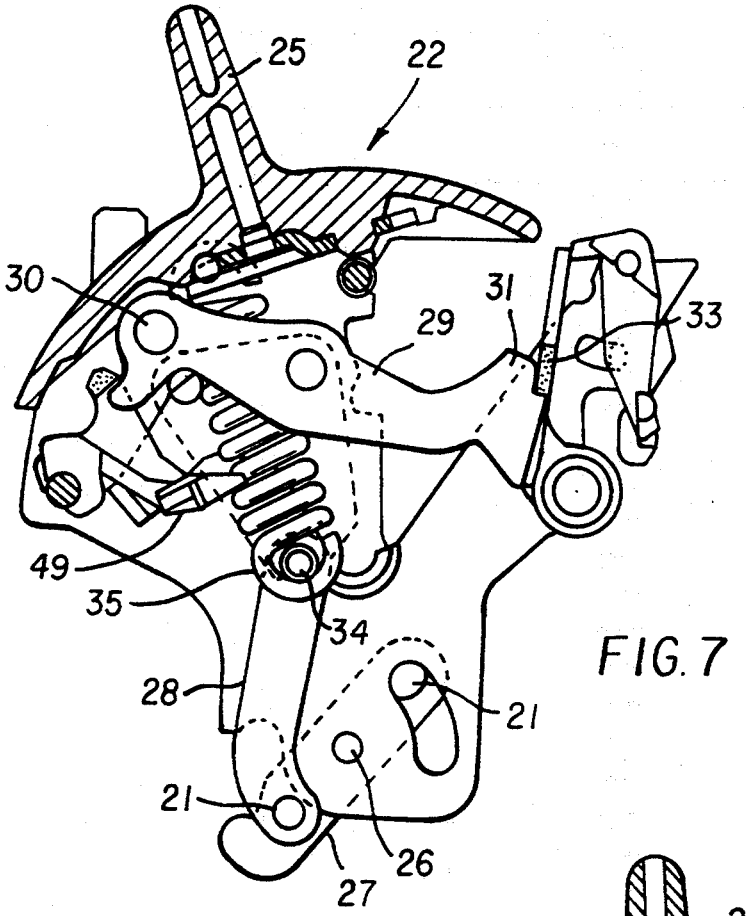
FIGS. 7 and 8 are cross-sections of the mechanism represented respectively in the set position and in the discharged position.
Figure 8:
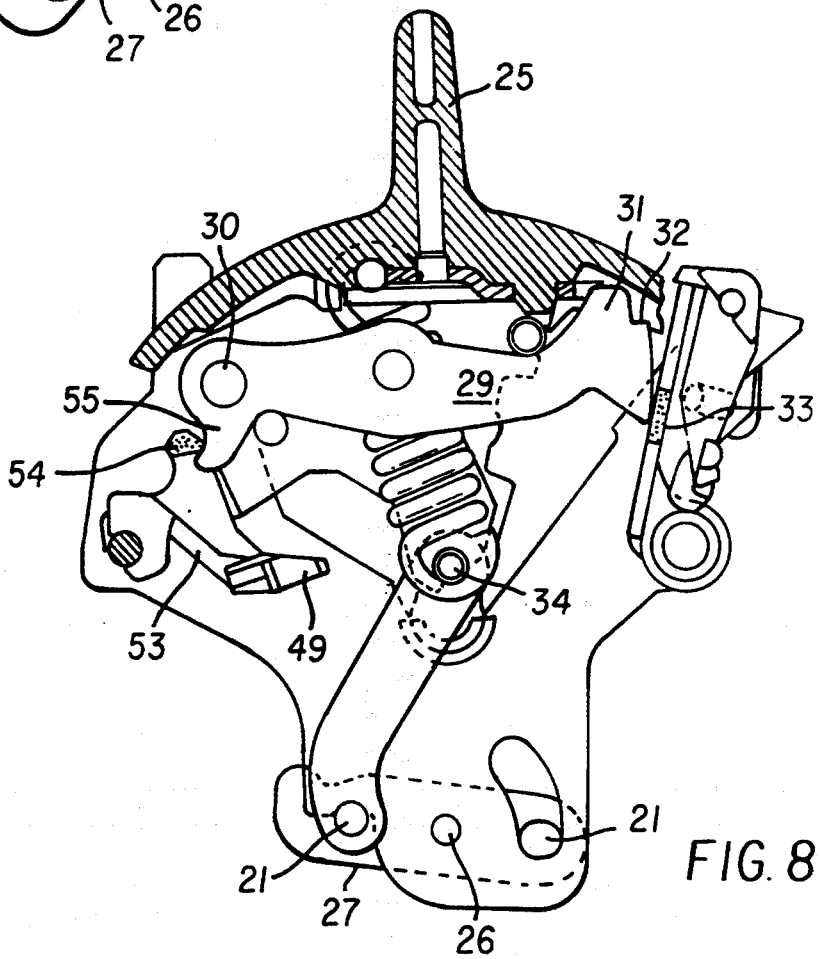

Referring more particularly to FIGS. 6, 7 and 8, it can be seen that the control device 49 of the tripping indication compartment 38 takes the information from the hook 29. For this purpose, a rocker 53 bears on the one hand the control device 49 and on the other hand a stop 54 held against a nose 55 of the hook 29. Resetting of the hook 29, from the discharged position, represented in FIG. 8, by clockwise pivoting of this hook, causes a counterclockwise rotation of the rocker 53 and upward movement of the control device 49 which acts on (i.e., pushes) 46 which is located in compartment 38. Tripping causes a reverse movement of the hook 29 on the rocker 53 control device 49, which then releases the pushbutton 46. The position of the contact blade 43 of the associated auxiliary unit 41 represents that of the hook 29 and thus indicates any tripping of the circuit breaker.

Figure 11:
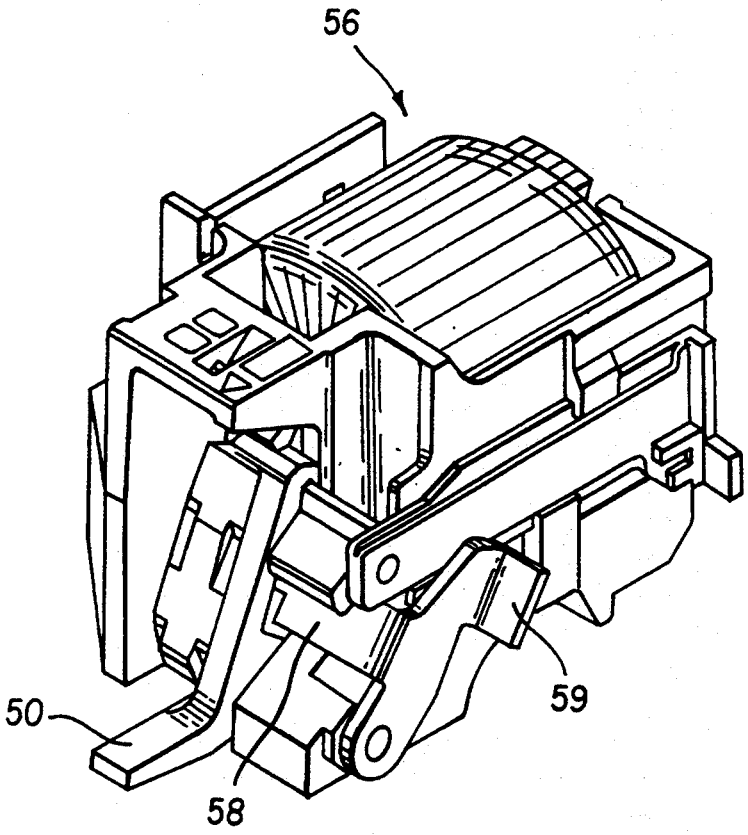
FIG. 11 is a schematic perspective view of a control relay and of the control device of the compartment associated with this control relay.

The other compartment 39 indicates tripping on an electrical fault, and for this purpose its control device 50 is associated with a trip control relay 56. The relay 56, illustrated by FIG. 11, is an electromagnet housed in a compartment 57 of the cover 12, facing the compartment 39, the relay actuating a pivoting assembly 58 having on the one hand a stop 59 for actuating the circuit breaker tripping latch 33, and on the other hand a lever forming the control device 50. It should be noted that transmission to the auxiliary unit 41 can naturally be performed in a different manner and that the relay 56 can be located or arranged in a different manner.

Implementation of the invention is obvious from the above description. The circuit breaker comprises four compartments 37–40, two 37, 40 of said compartments performing the function of circuit breaker contact position indication, another compartment 38 indicating the tripped position, and the fourth compartment 39 performing the function of electrical fault indication. If the fitter or distributor wants to have available an indication of the contact position, he fits an auxiliary unit 41 in compartment 37 or 40, or in both if the information is to be provided twice. Fitting is simple, as the auxiliary unit 41 merely has to be clipped into place, and this operation is performed without any risk, the compartments 37-40 being closed with respect to the base 11 of the circuit breaker, which contains the active parts.

Depending on the functions required, he fits an auxiliary unit 41 in one of the other compartments 38 or 39, or if he requires all the functions, the fitter fits auxiliary units 41 in each of the compartments 37–40. Access to these compartments 37–40, 57 is then prevented by fitting the plate before closing the cover 12. Subsequent removal or addition of an auxiliary unit 41 can naturally be performed easily after the front plate has been removed. A single circuit breaker can comprise a larger or smaller number of compartments, which can be assigned to other functions defined when the circuit breaker is manufactured. The choice of the function results from the choice of the compartment in which the standard auxiliary unit 41 is fitted. The location and arrangement of these compartments can be different and the connections of the control devices of these compartments with the corresponding components of the circuit breaker can be achieved in a different manner, notably electrically or by any other means.

We claim:

1. A low-voltage electrical circuit breaker, comprising:

a plurality of juxtaposed poles, each pole comprising at least one stationary contact, a movable contact and a bar section bearing the movable contact;

a molded case which houses said poles, said molded case having a base and a cover, and a plurality of compartments arranged in said cover;

a spring mechanism for actuating the bar sections, said spring mechanism having two stable positions, including a set position and a discharged position;

a manual operating handle connected to said spring mechanism, said manual operating handle protruding through said cover;

a trip device for automatically opening said movable and stationary contacts when a fault occurs; and at least one auxiliary unit adapted for reception in any of the compartments, said at least one auxiliary unit being adapted to perform at least one of an indication and control function, wherein each compartment has a standard configuration and includes a control device for activating said at least one auxiliary unit.

2. The circuit breaker of claim 1, wherein said circuit breaker includes a plurality of auxiliary units, each auxiliary unit having substantially the same dimensions.

3. The circuit breaker of claim 1, wherein said at least one auxiliary unit comprises an auxiliary contact and a push button for actuating said auxiliary contact, said push button being adapted to be urged by said control device.

4. The circuit breaker of claim 1, wherein one of said compartments is adapted to receive said at least one auxiliary unit for indication of tripping of the circuit breaker, the circuit breaker further comprising a hook for setting and disarming said spring mechanism, wherein the respective control device of said one of said compartments is actuated by said hook.

5. The circuit breaker of claim 1, wherein one of said compartments is adapted to receive said at least one auxiliary unit for indicating tripping of the circuit breaker due to an electrical fault, said circuit breaker further comprising a control relay which is initiated via an electrical fault, the spring mechanism further comprising a trip bar which is actuated by said control relay, wherein the respective control device of said one of said compartments is connected to said control relay.

6. The circuit breaker of claim 1, wherein the cover comprises a first part in which said compartments are formed and a second part which covers said compartments, the second part allowing access to said compartments after removal thereof.

7. The circuit breaker of claim 6, wherein each compartment has an opening for access to its respective control device.

8. The circuit breaker of claim 1, wherein each pole is housed in the base of said molded case, said movable contact consists of a movable contact bridge, and said at least one stationary contact consists of two stationary contacts, each pole further comprising a housing comprised of molded plastic material, said bar section being housed within said housing, the bar sections of the poles being mechanically connected to each other and to said spring mechanism, and the compartments being located on the housings.

9. The circuit breaker of claim 8, wherein one of said compartments is adapted to receive said at least one auxiliary unit for indication of open and closed positions of the movable and stationary contacts, and the respective control device of said one of said compartments is mechanically connected to said bar section.

10. The circuit breaker of claim 9, wherein said respective control device comprises a slide inserted between two adjacent housings, said circuit breaker further comprising a connecting bar passing through the bar sections, said slide being actuated by said connecting bar.

* * * * *